US006743380B2

(12) United States Patent
Kelley et al.

(10) Patent No.: US 6,743,380 B2
(45) Date of Patent: Jun. 1, 2004

(54) HIGH TEMPERATURE ELECTRICALLY CONDUCTIVE MATERIAL

(75) Inventors: Kurtis Chad Kelley, Washington, IL (US); Jill Elizabeth Rockwood, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 218 days.

(21) Appl. No.: 10/029,207

(22) Filed: Dec. 28, 2001

(65) Prior Publication Data

US 2003/0122110 A1 Jul. 3, 2003

(51) Int. Cl.[7] ..... H01B 1/16
(52) U.S. Cl. ..... 252/514; 252/521.5
(58) Field of Search ..... 252/514, 518.1, 252/521.5; 423/15, 23, 306

(56) References Cited

U.S. PATENT DOCUMENTS 2,536,962 A 1/1951 Sorg
3,607,351 A 9/1971 Lee
3,681,511 A 8/1972 Miller
4,511,524 A 4/1985 Nemeth et al.
4,659,404 A 4/1987 Butt
4,712,161 A 12/1987 Pryor et al.
4,996,171 A * 2/1991 Davey et al. ..... 501/19
5,066,540 A * 11/1991 Mosser et al. ..... 428/336
5,620,645 A 4/1997 Crumpacker et al.
5,863,481 A 1/1999 Crumpacker et al.
5,951,918 A 9/1999 Kuwajima et al.
5,977,490 A 11/1999 Kawakita et al.
6,156,237 A 12/2000 Kubota et al.
6,207,081 B1 3/2001 Sasaki et al.

* cited by examiner

*Primary Examiner*—Mark Kopec
(74) *Attorney, Agent, or Firm*—Finnegan, Henderson, Farabow, Garrett & Dunner

(57) ABSTRACT

An electrically conductive material that includes a phosphate glass having a chemical formula $AB(PO_4)$. Ag particles are dispersed within the phosphate glass in an amount of between about 8% to about 70% by volume. The invention includes a method for making the disclosed electrically conductive material.

18 Claims, 1 Drawing Sheet

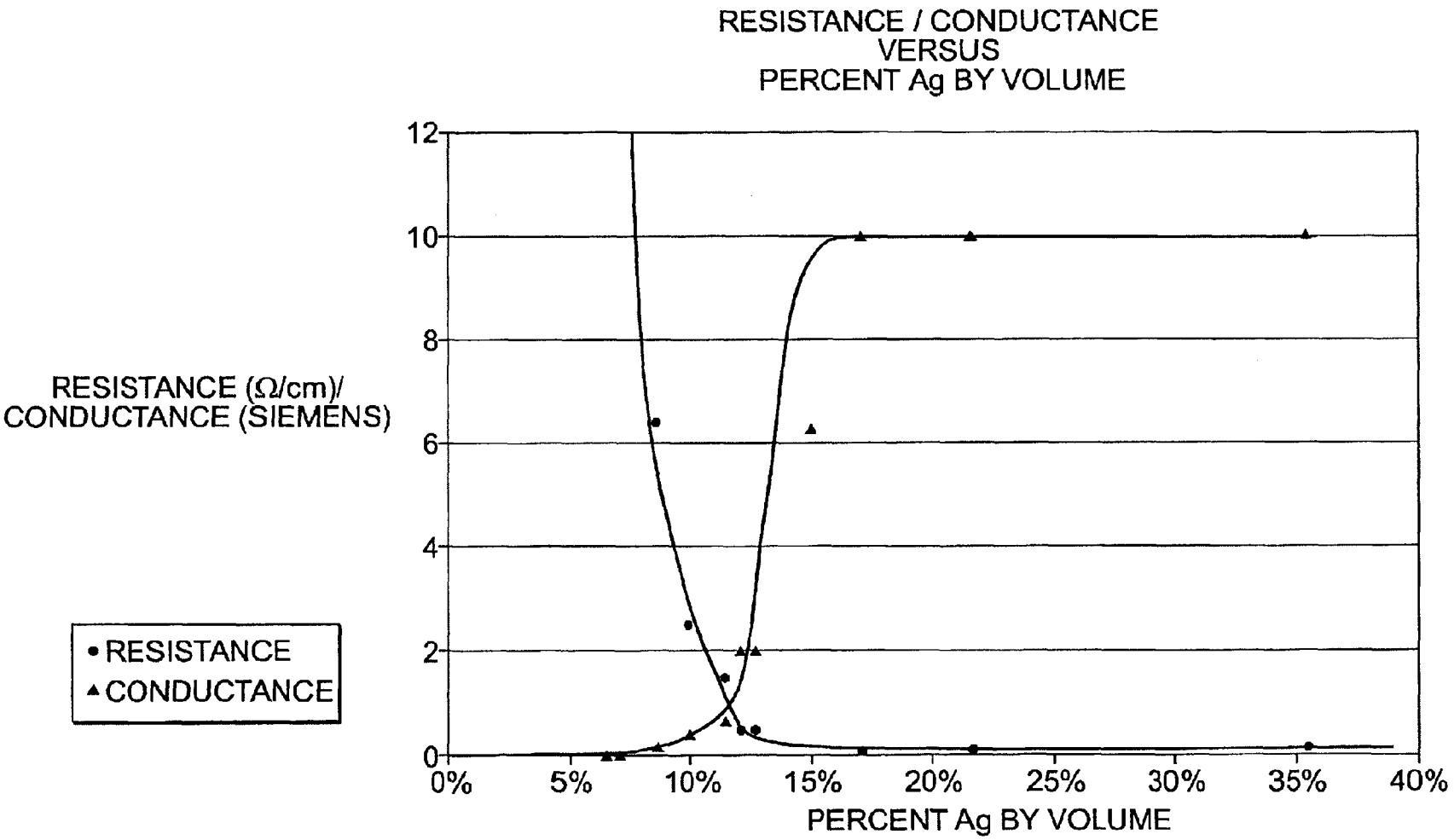
RESISTANCE / CONDUCTANCE
VERSUS
PERCENT Ag BY VOLUME
RESISTANCE (Ω/cm)/
CONDUCTANCE (SIEMENS)
12
10
8
6
4
2
0
0%
5%
10%
15%
20%
25%
30%
35%
40%
PERCENT Ag BY VOLUME
• RESISTANCE
▲ CONDUCTANCE

HIGH TEMPERATURE ELECTRICALLY CONDUCTIVE MATERIAL

TECHNICAL FIELD

This invention relates generally to electrically conductive materials and, more particularly, to high-temperature electrically conductive materials that are curable at low temperatures.

BACKGROUND

Conductive adhesives and pastes are well known. Generally, these materials include an organic polymer binder material filled with varying amounts of different types of conductive metals. U.S. Pat. No. 6,156,237 discloses an example of one such material. Specifically, this patent describes a conductive paste that includes an organic binder, an inorganic glass or ceramic powder, a conductive metal, and a mono-ol compound.

One problem of organic-based conductive materials is their tendency to exhibit fairly high curing temperatures and relatively low operating temperatures. The material of the '237 patent, like other materials of this type, requires a high curing temperature of about 850° C. Even the best performing materials of this type, however, generally have operating temperatures that do not exceed 250° C. Also, materials of this type, while electrically conductive, generally have fairly high resistance values in the range of about 30 Ω/cm to about 50 Ω/cm. Furthermore, these materials often lack good adhesion to various surfaces, especially ceramics, and many lose their electrically conductive and adhesive properties over time.

It should be noted that the curing temperature for a material is a temperature necessary to transform a green material, or uncured material, into a material having a desired set of characteristics and properties. The operating temperature refers to an upper temperature limit below which a given material maintains a particular property or characteristic. For example, an operating temperature may be marked by a temperature where a material melts or begins to soften to a point where desired structural characteristics of the material are degraded below a predetermined level. In addition to structural properties, the operating temperature may be related to any temperature-dependent characteristic of a material.

Another category of electrically conductive materials, namely aluminum-filled phosphate coatings, is also known. These materials, however, are available only as thin coatings. Further, they require high temperature curing (about 650° C.–about 850° C.) and need bead peaning to develop electrical conductivity.

The present invention solves one or more of the problems associated with the methods and materials of the prior art and provides a high-temperature, electrically conductive material having a low curing temperature and low resistance.

SUMMARY OF THE INVENTION

One aspect of the present invention includes a method of making an electrically conductive material. This method includes supplying a phosphate binder and adding Ag particles to the binder to obtain a mixture including Ag in an amount of between about 8% to about 70% by volume. The mixture is dried for a predetermined length of time. The dried mixture is then cured.

A second aspect of the present invention includes an electrically conductive material. This material includes a phosphate glass having a generic chemical formula of $AB(PO_4)$, where A is selected from Al, Fe, and oxides thereof, and where B is selected from Cr, Mo, and oxides thereof. Ag particles are dispersed within the phosphate glass in an amount of between about 8% to about 70% by volume.

BRIEF DESCRIPTION OF THE DRAWINGS

The accompanying FIGURE, which is incorporated in and constitutes a part of this specification, illustrates data relating to exemplary embodiments of the invention and, together with the written description, serves to explain the principles of the invention. In the drawings:

The sole FIGURE illustrates resistance and conductance data, for an exemplary embodiment of the invention, as a function of percent Ag by volume.

DETAILED DESCRIPTION

In the following description, exemplary embodiments in which the invention may be practiced are described in sufficient detail to enable those skilled in the art to practice the invention. It is to be understood that other embodiments may be utilized and that changes may be made without departing from the scope of the present invention. The following description is, therefore, not to be taken in a limited sense.

As a general overview, the process for making an electrically conductive material according to an exemplary embodiment of the present invention includes first preparing a phosphate binder. Next, Ag particles are added to the phosphate binder. At this stage, the consistency of the green material, which is an uncured mixture including the Ag particles dispersed in the phosphate binder, may be adjusted to suit a desired application of the material. Details relating to varying the consistency of the green material are provided below. Further, if desired, the green material may also be formed into a predetermined shape. The green material is then dried and subsequently cured. During the curing step, the temperature of the green material is slowly raised. The rising temperature forces the release of any water remaining in the mixture after the drying step. Ultimately, the temperature reaches a "false melt" temperature. At this temperature, an irreversible structural change occurs in the green material. Tightly held water is released from the green material, which allows a reconfiguration of the chemical bonds between the constituents of the mixture. Subsequent to achieving the false melt temperature, the green material hardens into a stable, electrically conductive material.

Returning to the details of preparing the phosphate binder, preparation of the phosphate binder may begin with a solution of phosphoric acid and water. Adjusting the pH of this solution will affect the physical characteristics of the phosphate binder, which directly influences the physical characteristics of the green material. In general, as the pH is decreased, the resulting green material will be softer due to the retention of additional water within the structure. For example, a pH of approximately 0.85 will yield a green material that remains flexible and pliable even after drying. As the pH is increased, however, the resulting green material becomes denser, and upon drying, the green material eventually becomes hard and non-pliable.

Once the desired pH of the phosphoric acid-based solution has been obtained, a first metal oxide is dissolved into the solution. In one exemplary embodiment, this first metal oxide may include chromium oxide. In yet another embodiment, molybdenum oxide may be substituted for chromium oxide. Next, a second metal oxide is added to the solution. In an exemplary embodiment, this second metal oxide may include aluminum oxide. In yet another embodiment, the second metal oxide may include iron oxide. The second metal oxide may be added to the solution in forms ranging from a solid block of material to nanometer-scale particles.

The second metal oxide slowly dissolves into the solution. As it dissolves, hydrogen atoms of the phosphoric acid are replaced with metal ions from both the first and second metal oxides, thus liberating hydrogen atoms. Over time, the mixture develops an amorphous, glass-like structure through substitution of the hydrogen atoms in the acid. The presence of the first metal oxide encourages the growth of the glass structure by interrupting crystal formation that may otherwise occur. The reaction is suitably complete when no further gas is evolved from the mixture and a skin forms over the solution upon exposure to air. Any unreacted solids are centrifuged out, and the resultant syrup-like liquid represents the phosphate binder. In general, the phosphate binder has a chemical formula $AB(PO_4)$, where A is selected from one of Al, Fe, and oxides thereof, and B is selected from one of Cr, Mo, and oxides thereof.

As the next step of forming the electrically conductive material of the present invention, Ag particles are added to the phosphate binder. The Ag particles have a size of less than about 5 $\mu$m. While particle sizes of between about 1 $\mu$m to about 5 $\mu$m distribute easily within the phosphate binder and are suitable for use in various embodiments of the present invention, particle sizes of less than 1 $\mu$m are also useful. The Ag particles are added to the phosphate binder in an amount of between about 8% to about 70% by volume.

At this stage, the phosphate binder and Ag particle mixture may take on the consistency of a thick paste. Optionally, the consistency of the mixture may be adjusted by adding acidified water (e.g., a solution of water and phosphoric acid) to the mixture. Through addition of the acidified water, the viscosity of the mixture may be reduced. The reduced viscosity is useful, for example, in coating various surfaces with the phosphate binder and Ag particle mixture. The additional acid present in the mixture may even aid in producing a stronger false melt during curing. It is possible, however, that too much acidified water at this stage can actually hinder the occurrence of the false melt transition. In general, an addition of acidified water in an amount of up to about 10–15% by volume will not impede the false melt process.

In addition to the possibility of adding acidified water to the mixture of Ag particles in the phosphate binder, other additives may optionally be included in the mixture. For example, in one exemplary embodiment, BN may be added to the phosphate binder along with the Ag particles. Once the material has been cured, the presence of BN aids in the reduction of the coefficient of friction at the surface of the material. Thus, parts formed of the electrically conductive material including BN exhibit superior wear properties and are useful in many applications requiring low-friction, conductive materials. BN may be added to the phosphate binder/Ag particle mixture in an amount of up to about 5% by volume. Depending on a given application, other materials that reduce the coefficient of friction of the of the material may be either substituted for or added to the phosphate binder/Ag particle mixture.

Once all of the desired additives have been incorporated into the phosphate binder and the resulting mixture has the desired consistency, the mixture may be formed into a desired shape. For thinner consistencies, the mixture may be painted onto a surface to serve as an electrically conductive coating on, for example, an electrode. It is also possible to construct an electrode or other elements by molding and/or forming the mixture into a desired shape. As yet another possibility, thicker pastes may be spread into cracks on various surfaces to serve as a surface repair material. Additionally, the material may be lumped onto a surface, and a mold of a desired shape may be pressed down upon the material such that the resulting structure, having the desired shape, is formed directly on and adheres to the surface.

Once the material has been configured according to the desired application, the material is dried at a temperature of up to about 100° C. for a predetermined length of time. For example, in an exemplary embodiment, the material could be dried for one or more weeks. Drying times, however, vary depending on the accuracy of the binder mixture, the amount of water lost from the binder during processing, the dimensions of the part being formed, and oven configuration, etc. Therefore, drying times of significantly less or significantly more than two weeks may be possible. By drying the material, a sufficient amount of water is removed from the element to form a stable unitary mass. For example, after drying, the material may include a moisture content of about 0.5% to about 1% water by volume. It is even possible to re-hydrate the material after drying by placing the material into a humidity chamber.

During drying, pressure may be applied to the material, through a die of a mold for example, to densify the material to a predetermined porosity level and to deform the material to predetermined final dimensions. As discussed previously, subsequent to drying, the material may exhibit a range of structural properties depending on the conditions of the initial preparation of the phosphate binder, as well as whether or not any additional acidified water was added after forming the phosphate binder/Ag particle mixture. For example, the material may be flexible and pliable, or it may be more rigid.

Once the material has been dried, it is ready for curing. The curing process proceeds by ramping the temperature of the material upward such that the mixture is ultimately subjected to a curing temperature of greater than about 180° C., which is the approximate temperature where the false melt transition occurs, but less than about 230° C. In the exemplary embodiment, the temperature is increased to the false melt transition temperature, or moderately above, over approximately one hour. Of course, this time will vary according to shape and configuration of the material being cured. For example, the temperature of thin films may be increased more quickly than for thicker parts having complex shapes. By slowly increasing the temperature of the material over, for example, one hour, water that is trapped within the structure of the material is allowed sufficient time to diffuse through the material as molecular water without damaging the material. For example, if the temperature of the material is increased too quickly, steam could form and could lead to fracture or rupture of the material. Once the false melt transition has occurred and the material is cooled, it is ready for use.

The term "false melt" refers to a change in the material upon heating to a specific transition temperature. At or about this transition temperature, the material temporarily takes on plastic properties and mimics a melt. Unlike a true melt, which occurs at a much higher temperature and where the composition of the material is unchanged, some material is lost during the "false melt". In theory, at the false melt transition temperature, sufficient energy has been introduced into the system to release chemical bonds and/or tightly held water that are not affected by drying at lower temperatures. The phosphate binder, which is still partly hydrated after drying, is momentarily dissolved in the newly released water and the mixture softens. Once the released water has escaped from the material, the material hardens into a stable form. The false melt transition is irreversible (i.e., the material cannot be re-hydrated). Because very little water is actually involved, a minimal amount of porosity due to water loss results.

Once cured, the resulting material is a dense, hard, and electrically conductive phosphate glass. While the material is cured at a relatively low temperature of, for example, about 180° C., the material has an operating temperature of up to about 900° C. The material also has excellent electrical conductivity and displays low resistance values. For example, resistance values of 0.1 Ω/cm or less have been achieved with as little as about 17% Ag by volume. Even with only about 8% by volume of Ag, the material still exhibits a resistance of less than about 6 Ω/cm. It is an unusual feature of this material, in fact, that it displays such low resistance values upon addition of such a small amount of electrically conductive material into the phosphate binder.

Industrial Applicability

The electrically conductive material of the present invention, by being curable in any configuration and by exhibiting high conductivity, is useful in making high voltage contacts for use in, for example, ceramic sensors, piezoelectric devices, and timing mechanisms. With discrete particles dispersed in a phosphate glass binder, the electrically conductive material of the present invention offers an attractive alternative to ordinary metal contacts that tend to weld together upon repeated application of high voltage. In contrast to ordinary metal contacts, contacts made from the electrically conductive material of the present invention do not suffer from a transfer of material from one contact to the other upon application of high voltage to the contacts. As a result, contacts made from the electrically conductive material of the present invention exhibit a much longer service life versus those fabricated from ordinary metal.

Additionally, the electrically conductive material of the present invention can be configured to provide a low-friction solution for high voltage contacts. Specifically, through the addition of BN, the coefficient of friction for the material is reduced while the electrical properties of the material are preserved. As a result, such a material is suitable for use in applications including sliding, high voltage contacts. The lower coefficient of friction provided by the addition of BN serves to prolong the life of the contacts by decreasing frictional wear.

In yet another application, the electrically conductive material of the present invention is useful as a surface repair material. The material can be applied as a liquid, paste, putty, or compactable powder, and it has excellent adhesion to most ceramic materials and some metals, including aluminum. The material also finds application as an adhesive, as a coating, or as a substitute for solder in bonding electrodes to coated surfaces, for example.

Other aspects and features of the present invention can be obtained from a study of the drawings, the disclosure, and the appended claims.

What is claimed is:

1. An electrically conductive material, comprising:

a phosphate glass having a chemical formula $AB(PO_4)$, where A is a first metallic material and B is a second metallic material; and Ag particles dispersed within the phosphate glass in an amount of between about 8% to about 70% by volume, wherein the first metallic material is selected from one of Al, Fe, and oxides thereof.

2. The electrically conductive material of claim 1, wherein the second metallic material is selected from one of Cr, Mo, and oxides thereof.

3. The electrically conductive material of claim 1, further including BN dispersed within the phosphate glass in an amount of up to about 5% by volume.

4. The electrically conductive material of claim 1, wherein said Ag particles are less than about 5 microns in size.

5. The electrically conductive material of claim 1, wherein said electrically conductive material has a resistance in a range of about 0.1 Ω/cm to about 6 $\Omega/cm^2$.

6. The electrically conductive material of claim 1, wherein said electrically conductive material has a curing temperature of between about 180° C. and 230° C.

7. The electrically conductive material of claim 1, wherein said electrically conductive material has an operating temperature of up to about 900° C.

8. An electrically conductive material, comprising:

a phosphate glass having a chemical formula $AB(PO_4)$, where A is selected from one of Al, Fe, and oxides thereof, and B is selected from one of Cr, Mo, and oxides thereof; and Ag particles of a size less than about 5 μm that are dispersed within the phosphate glass in an amount of between about 8% to about 70% by volume, wherein said electrically conductive material has a curing temperature of between about 180° C. and 230° C. and an operating temperature of up to about 900° C.

9. The electrically conductive material of claim 8, wherein said electrically conductive material has a resistance in a range of about 0.1 Ω/cm to about 6 Ω/cm.

10. The electrically conductive material of claim 8, further including BN dispersed within the phosphate glass in an amount of up to about 50% by volume.

11. A method of making an electrically conductive material, comprising:

beginning with a phosphate binder;

adding Ag particles to the binder to obtain a mixture including Ag in an amount of between about 8% to about 70% by volume;

drying the mixture for a predetermined length of time; and curing the mixture, wherein said phosphate binder has a chemical formula of $AB(PO_4)$, and A is selected from one of Al, Fe, and oxides thereof.

12. The method of claim 11, wherein B, of the formula $AB(PO_4)$, is selected from one of Cr, Mo, and oxides thereof.

13. The method of claim 11, wherein the curing step includes ramping a temperature of the mixture upward such that the mixture is ultimately subjected to a curing temperature of greater than about 180° C., but less than about 230° C.

14. The method of claim 11, further including adjusting a consistency of the phosphate binder by adding acidified $H_2O$.

15. The method of claim 11, wherein the step of drying further includes placing the mixture under pressure.

16. The method of claim 11, further comprising adding BN to the phosphate binder in an amount of up to about 5% by volume.

17. The method of claim 11, wherein said electrically conductive material has an operating temperature of at least three times greater than a temperature used to cure the mixture.

18. The method of claim 11, wherein the drying step proceeds until a moisture content of the mixture is between about 0.5% to about 1% water by volume.

* * * * *